US006236151B1

(12) United States Patent
Murakami et al.

(10) Patent No.: US 6,236,151 B1
(45) Date of Patent: May 22, 2001

(54) GLASS PANEL FOR AN IMPLOSION-PROTECTED TYPE CATHODE RAY TUBE

(75) Inventors: Toshihide Murakami; Tsunehiko Sugawara, both of Funabashi (JP)

(73) Assignee: Asahi Glass Company Ltd., Tokyo (JP)

( * ) Notice: Subject to any disclaimer, the term of this patent is extended or adjusted under 35 U.S.C. 154(b) by 0 days.

(21) Appl. No.: 09/266,788

(22) Filed: Mar. 12, 1999

(30) Foreign Application Priority Data

Mar. 26, 1998 (JP) ..... 10-079717

(51) Int. Cl.[7] ..... H01J 31/00

(52) U.S. Cl. ..... 313/402; 313/402; 313/461; 348/821; 220/2.1 A

(58) Field of Search ..... 313/402, 407, 313/408, 476, 420, 477 R, 479, 461; 220/2.1 A, 2.3 R; 348/821, 823

(56) References Cited

U.S. PATENT DOCUMENTS

Re. 36,838 * 8/2000 Sugawara et al. ..... 313/477 R
4,639,636 * 1/1987 Bakker et al. ..... 313/477 R
5,568,011 10/1996 Ragland, Jr. et al. ..... 313/477 R
5,925,977 * 7/1999 Sugawara et al. ..... 313/477 R
6,011,350 * 1/2000 Opresko et al. ..... 313/477 R
6,121,723 * 9/2000 Sugawara et al. ..... 313/477 R

FOREIGN PATENT DOCUMENTS 2 318 905 5/1998 (GB) .
2 322 731 9/1998 (GB) .

* cited by examiner

*Primary Examiner*—Nimeshkumar D. Patel
*Assistant Examiner*—Mariceli Santiago
(74) *Attorney, Agent, or Firm*—Oblon, Spivak, McClelland, Maier & Neustadt, P.C.

(57) ABSTRACT

A glass panel for an implosion-protected type cathode ray tube is provided with a compressive stress of 7 MPa–30 MPa in an outer surface of a face portion and a relation of $R_b \geqq 0.017D+4.0$ between the radius of curvature $R_b$ of an outer surface of a blend R portion 9 in a diagonal portion of the glass panel and the largest outer diameter D of the glass panel Further, when the face portion is substantially flat, there is a relation of $T_r \leqq 0.014D+11.0$ wherein $T_r$ is the largest wall thickness of the blend R portion.

7 Claims, 2 Drawing Sheets

GLASS PANEL FOR AN IMPLOSION-PROTECTED TYPE CATHODE RAY TUBE

BACKGROUND OF THE INVENTION

1. Field of the Invention

The present invention relates to a glass panel for a cathode ray tube used mainly for receiving TV broadcasting and for industrial equipments.

2. Discussion of Background

As shown in FIG. 3 a cathode ray tube 1 has a glass bulb 2 which is generally composed of a glass panel 3 for displaying a picture image, a funnel portion 4 mounted thereon a deflection coil and a neck portion 5 for housing an electron gun 17.

In FIG. 3, reference numeral 6 designates a panel skirt portion, numeral 7 designates a face portion on which a picture image is displayed, numeral 8 designates an anti-implosion band for providing strength against a mechanical shock, numeral 9 designates a blend R portion connecting the face portion to the skirt portion, numeral 10 designates a sealing portion at which the glass panel 3 and the funnel portion 4 are sealed with a solder glass or the like, numeral 12 designates a fluorescent layer for emitting fluorescence by irradiating electron beams, numeral 13 designates an aluminum layer for reflecting forwardly the fluorescence at the fluorescent layer, numeral 14 designates a shadow mask which specifies positions of electron beams on a fluorescent substance, numeral 15 designates a stud pin for fixing the shadow mask 14 to an inner surface of the skirt portion 6,and numeral 16 designates an inner conductive coating which prevents the shadow mask 14 from being charged to a high potential by the electron beams and which grounds electric charges to the outside. A symbol A indicates a tube axis connecting the central axis of the neck portion 5 to the center of the glass panel 3. The fluorescent layer 12 is formed on an inner surface of the glass panel to thereby form a screen. The screen is substantially in a rectangular shape constituted by four side lines which are in substantially parallel to a long axis and a short axis which cross at a right angle to the tube axis A at the center of the tube axis A.

The inside of the cathode ray tube is kept under a highly vacuumed condition because a picture image is displayed by irradiating electron beams on the face portion. The cathode ray tube has an asymmetric shape unlike a spherical shape and suffers a difference of 1 atmospheric pressure between-the outside and inside of the glass panel. Accordingly, there exists a high deformation energy and is under an unstable condition. Under such condition, when a crack is generated in the glass panel, the crack tends to extend rapidly to release the high deformation energy whereby there causes a large scale destruction of the glass panel wherein a number of cracks expand into the entire of the panel.

In particular, when the rate of crack extension is high in a case such as the destruction by a mechanical shock, the glass panel is broken instantaneously. In this case, there cause an implosive shrinkage phenomenon and the reaction thereof which result an intensive implosion wherein a large amount of glass pieces are scattered. In many cases, a reinforcing band 8 is attached to a side surface of the glass panel 3 to protect a user from the implosion and to suppress the extension of the cracks and the breakage of the bulb body.

In recent years, the face portion of the g lass panel tends to be flattened in order to improve the visibility of the cathode ray tube. With this, there is a tendency that the asymmetry of the cathode ray tube derived from its structure becomes remarkable whereby an implosion can be occurred.

In the cathode ray tube having the above-mentioned structure, when a mechanical shock is given to a diagonally opposing portion or its vicinity, which has structurally a high rigidity, a change of stress in terms of time generated in the diagonally opposing portion or its vicinity is sharp and large whereby a rate of occurrence of cracks is high. Further, since the speed of the extension of cracks is high, an implosion phenomenon is further apt to occur. Accordingly, it may be necessary to increase the wall thickness of the face portion to thereby reduce the stress to be generated in order only to prevent the implosion which is generated when a shock is given to the diagonally opposing portion. In this case, the weight of the cathode ray tube is increased, which is the great problem in the cathode ray tube.

SUMMARY OF THE INVENTION

It is an object of the present invention to provide a glass panel for a cathode ray tube which is safe in use and has a high implosion protecting effect by reducing selectively the rigidity of diagonally opposing portions in a face portion to thereby reduce a stress generated by a mechanical shock.

In accordance with the present invention, there is provided a glass panel for an implosion-protected type cathode ray tube comprising a face portion of substantially rectangular shape and a skirt portion constituting a side wall of the face portion, wherein a compressive stress $\sigma_c$ of 7 MPa$\leqq|\sigma_c|\leqq$30 MPa is formed by physically strengthening in at least an outer surface of the face portion, and the relation between the radius of curvature $R_b$ of an outer surface of a blend R portion connecting the face portion to the skirt portion in a diagonal portion of the glass panel and the largest outer diameter D of the glass panel is $R_b \geqq 0.017D+4.0$.

Further, there is provided the glass panel according to the above-mentioned, wherein the face portion is substantially flat, and the relation between the largest wall thickness $T_r$ of the blend R portion in the diagonal portion of the glass panel and the largest outer diameter D of the panel is $T_r \leqq 0.014D+11.0$.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
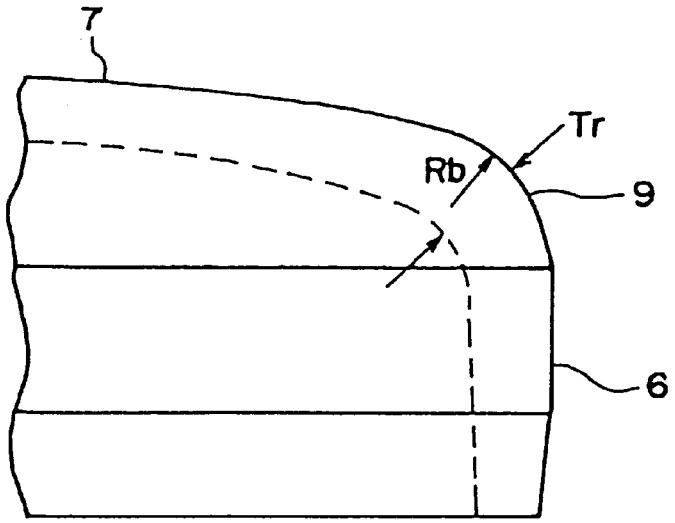
FIG. 1 is a longitudinal cross-sectional view showing a diagonally opposing portion sectioned along B—B line in FIG. 2 of a glass panel according to the present invention.

In the present invention, the shape and the wall thickness of a portion connecting the face portion to the skirt portion, which is a portion of diagonally opposing portions in the face portion of the glass panel having a substantially rectangular shape, are specified. As a result, the structural rigidity of the diagonally opposing portions is selectively reduced, while the function of the cathode ray tube as a vacuum envelopment is maintained, and a stress generated when a mechanical shock is given to any of the portions is reduced and the extension of a crack can be suppressed.

A stress generated in any of the diagonally opposing portions, when a mechanical shock is given to the portion, in the ordinary cathode ray tube is such that when the rigidity of that portion is high, the maximum value is increased as the result of which a time of generating the stress is shorter. On the contrary, when the rigidity is low, the maximum value is low and the time of generating the stress is longer. Further, when the magnitude of the generated stress is higher, the ratio of the occurrence of crack is higher. On the other hand, when a time of the occurrence of stress is shorter, a deformation energy caused by a shock tends to concentrate to the portion where the shock is given or its vicinity. In this case too, the rate of the occurrence of crack becomes high and the speed and the amount of the extension of crack are increased.

From the standpoint of preventing the implosion, it is desirable that the structural rigidity of the portion where a mechanical shock may be given is lower as long as the function of the cathode ray tube as a vacuum envelopment is maintained. In a glass panel for a cathode ray tube, a portion which possibly suffers a mechanical shock in use is a face portion exposed from a TV set. Since diagonally opposing portions in the face portion, each of which is constituted by connecting three planes of the glass panel of substantially box-like shape, have the highest rigidity in the structure of the face portion, an implosion can easily be occurred by a mechanical shock.

In order to suppress an implosion generated when a shock is given to any of diagonally opposing portions of the face portion, it is necessary to reduce the rigidity of the diagonally opposing portions. However, the shape of the face portion largely influences picture images displayed on the cathode ray tube, and accordingly, the flexibility in determining the shape is less. Further, the face portion constitutes the flattest and broadest area in the glass panel, and a change of the shape or the wall thickness of the face portion influences the rigidity of the entire structure of the glass panel.

The inventors of this application have found that the shape of a blend R portion in a diagonally opposing portions (hereinbelow, referred simply to a blend R portion) has a close relation to a reduction of the rigidity of the diagonally opposing portions, and have succeeded to reduce the rigidity by changing the shape of the blend R portion to change selectively the rigidity of the diagonally opposing portions where there is a high possibility of the occurrence of implosion, without causing influence to the quality of picture images.

Figure 2:
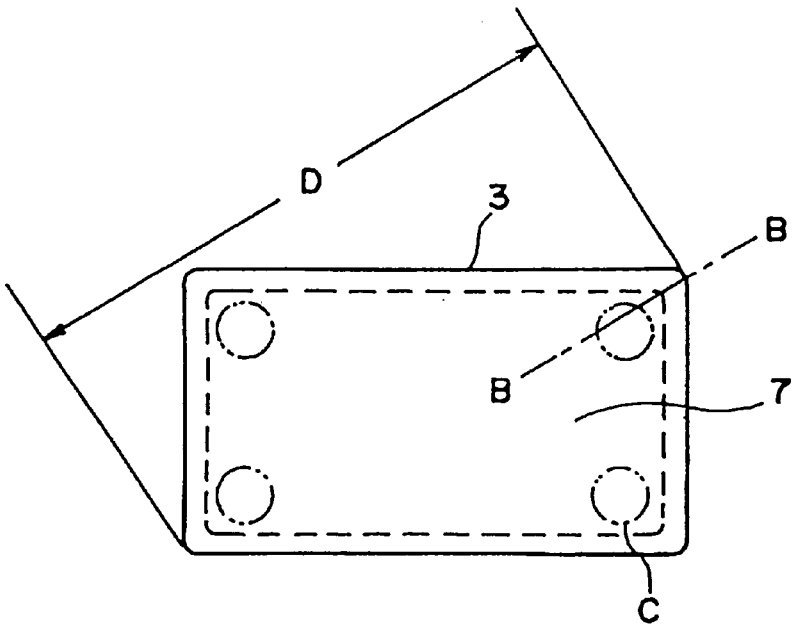
FIG. 2 is a plane view of the glass panel according to an embodiment of the present invention.

In the following, a preferred embodiment of the present invention will be described with reference to FIGS. 1 and 2 wherein FIG. 2 is a plane view of a glass panel 3 and FIG. 1 is a partly cross-sectional view of a diagonally opposing portion of the glass panel 3, which shows a portion sectioned along B—B line in FIG. 2. In FIG. 1, $R_b$ indicates the radius of curvature of an outer surface of a blend R portion 9 and $T_r$ indicates the largest wall thickness of the blend R portion 9. When the radius of curvature $R_b$ of the blend R portion 9 is not uniform, the largest radius of curvature of it is used. Further, the diagonally opposing portions in the face portion where there is a high possibility of the occurrence of an implosion are located at or near corners of the face portion 7. Accordingly, a symbol C in FIG. 2 indicates one of those portions conveniently.

The blend R portion 9 functions to support the face portion 7 against a mechanical shock applied to any of the diagonally opposing portions C. When the radius of curvature $R_b$ of the blend R portion is increased, the blend R portion 9 is provided with a flexible structure whereby a shock given to any of the diagonally opposing portions C in the face portion can be released. Specifically, the radius of curvature $R_b$ of an outer surface of the blend R portion 9 and the largest outer diameter D of the glass plane 3 have a relation of $R_b \geqq 0.017D+4.0$.

When $R_b \geqq 0.017D+4.0$, an effect of reducing the rigidity of the diagonally opposing portions C is reduced and a rate of the occurrence of an implosion is increased. In the formula, the largest outer diameter D means the largest dimension between opposing outer surfaces of the skirt portion 6 in the direction along the diagonal axis of the glass panel 3 as shown in FIG. 2. The radius of curvature $R_b$ of the outer surface of the blend R portion 9 is substantially constant in a range between the face portion and the skirt portion. However, when the value is different in that range, an averaged radius of curvature can be obtained.

In the present invention, on the premise that any influence should not be given to picture images displayed on the cathode ray tube, a substantial upper limit of the radius of curvature $R_b$ is determined so that the blend R portion is outside an effective display region which constitutes a screen surface in the face portion 7. Accordingly, even when the radius of curvature $R_b$ is increased to expand the blend R portion, it should not be extended into the screen surface. Further, when the radius of curvature $R_b$ is unnecessarily increased, a fastening effect by a reinforcing band which is attached to an outer periphery of the skirt portion 6 and on the diagonally opposing portion of the glass panel 3 may be educed. Accordingly, care should be taken to this point in the determination of $R_b$.

Further, the occurrence of cracks can further be suppressed by forming a compressive stress in at least a front surface of the glass panel by physically strengthening. It is because a tensile stress which is generated by a mechanical shock against the face portion is apparently reduced with the cooperation of the compressive stress formed by physically strengthening. In more detail, a compressive stress $\sigma_c$ should be formed in at least an outer surface of the face portion or the entire face portion in a range of 7 MPa$\leqq|\sigma_c|\leqq$30 MPa. When $|\sigma_c|\leqq$7 MPa, a sufficient effect can not be expected. On the other hand, when 30 MPa$<|\sigma_c|$, a self-propelling phenomenon of crack appears due to a force of releasing a residual strain energy stored in the glass panel by physically strengthening whereby an amount of the extension of cracks is increased. Accordingly, this is not practical for the purpose of suppressing the implosion. Accordingly, it is important to apply a physically strengthening treatment to the outer surface of the panel portion in the above-mentioned range of stress value. However, the compressive stress may be formed in not only an outer surface of the face portion but also an inner surface of the face portion, and inner and outer surfaces of the skirt portion. In general, the compressive stress formed except for the outer surface of the face portion is less than that of the outer surface of the face portion.

In the measurement of the above-mentioned compressive stress, a test piece having a predetermined size is cut off from an optional portion of the face portion, and a compressive stress in a surface of the test piece is measured with a photoelastisity analysis system apparatus in accordance with a direct method (Sénarmont method) ruled in JIS-S2305.

In a cathode ray tube having a substantially flat face portion which is formed to increase the visibility of the tube, when a crack is generated an implosion phenomenon is apt to occur in a cathode ray tube having a face portion provided with a radius of curvature. In a cathode ray tube having a substantially flat face portion, an asymmetrical structure becomes remarkable and an uniformity of deformation energy is increased. In addition, even when cracks are generated in the face portion having a radius of curvature whereby glass pieces are separated from the structure, the shape of the glass pieces has a wedge-like form whereby the glass pieces hold each other. On the other hand, in the cathode ray tube having a substantially flat face portion, the shape of glass pieces is substantially rectangular. In this case, the glass pieces are easily separated, and accordingly, there is a high possibility of the occurrence of an implosion.

Accordingly, in order to suppress the occurrence of n implosion phenomenon in the cathode ray tube provided with a face portion having a substantially flat surface, it is important to reduce more the possibility of the occurrence of cracks. For this purpose, it is necessary to reduce more the rigidity of the blend R portion. As factors to determine the rigidity of a portion in the glass panel, the shape and the wall thickness of the glass panel are in general effective. In a case of the cathode ray tube provided with a face portion having a radius of curvature, the purpose of reducing the occurrence of an implosion can be achieved to a fair extent by increasing the radius of curvature $R_b$ in an outer surface of the blend R portion as described above. However, in a case of the cathode ray tube provided with a face portion having a substantially flat surface, i.e., a face portion having a large radius of curvature, the rigidity of the blend R portion, i.e., the rigidity of a diagonally opposing portion in the face portion is more reduced. Accordingly, it is necessary to control the wall thickness of the blend R portion in addition to the radius of curvature $R_b$.

Specifically, the blend R portion can be provided with a low rigidity by satisfying a relation $T_r \leqq 0.014D+11.0$ between the largest wall thickness $T_r$ of the blend R portion and the largest outer diameter D of the glass panel. When the wall thickness of the blend R portion is made thin to provide a flexible structure, the concentration of stress can be relaxed or prevented. When $T_r > 0.014D+11.0$, the effect is reduced and a possibility of the occurrence of an implosion is increased. Of course, the blend R portion should have a certain value to assure the strength necessary as the valve for a cathode ray tube.

In the above-mentioned description, reference has not in particular been made about a blend R portion other than that of diagonally opposing portions of the glass panel. It is because the diagonally opposing portions are very important in reducing an implosion, and proper determination of the shape and the wall thickness of the blend R portion of the diagonally opposing portions, which are in the vicinity of the diagonally opposing portions in the face portion, is in particular effective to suppress an implosion in the glass panel. Accordingly, requirements to the shape and the wall thickness of the blend R portion other than that of the diagonally opposing portions in the glass panel is less severe than the requirement to the diagonally opposing portions, and accordingly, the shape and the thickness may be properly determined according to the conventional technique.

Now, the present invention will be described in detail with reference to Examples. However, it should be understood that the present invention is by no means restricted by such specific Examples.

EXAMPLE 1

Figure 3:
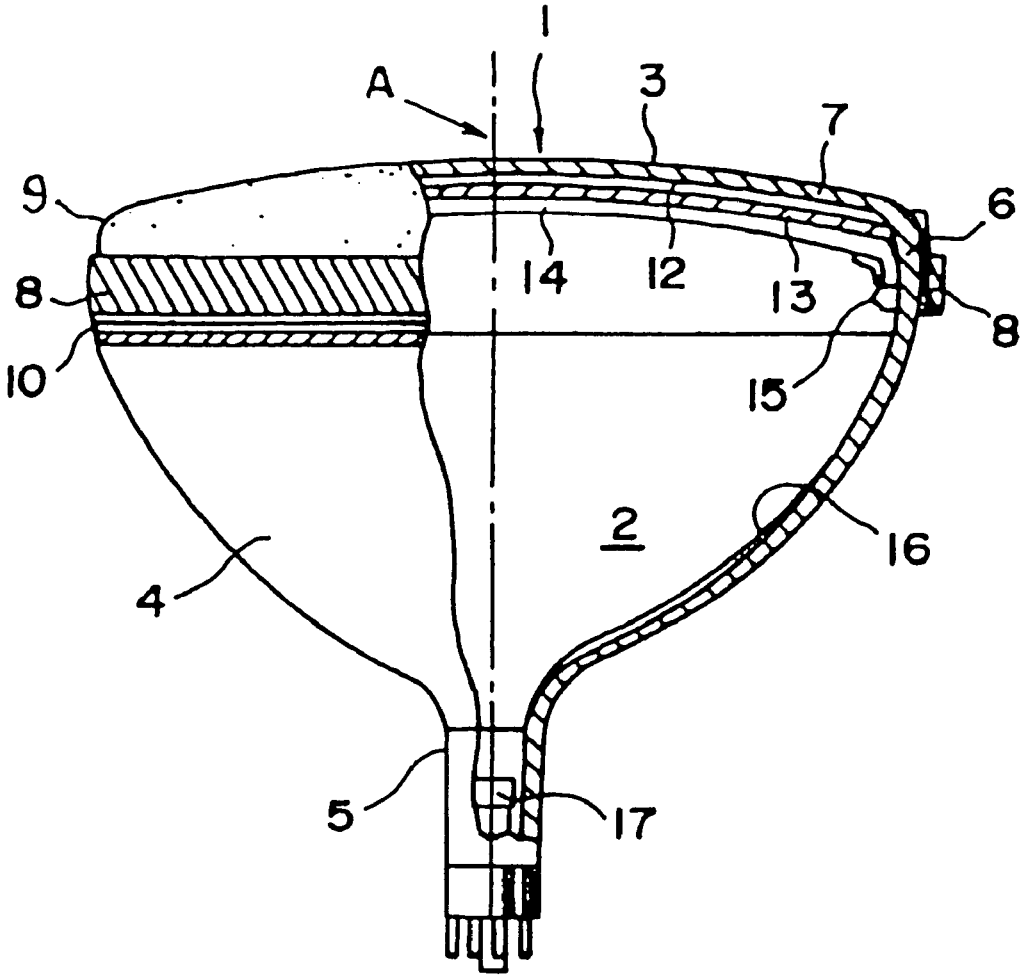
FIG. 3 PRIOR ART
FIG. 3 is an illustration of a cathode ray tube wherein its part is broken.

Glass panels used in Examples are those generally used for cathode ray tubes as shown in FIG. 3 and manufactured by Asahi Glass Company Ltd.

Each of the glass panels is one for TV of 29-inch model (a reflection angle of 108°) having an useful screen area of an aspect ratio of 4:3 and of a diagonal line of 68 cm. The radius of curvature $R_b$ of an outer surface of a blend R portion in a diagonally opposing portion was 16.5 mm. The glass panels used have the same configuration as a conventional glass panel (Comparative Example 1) having $R_b$ of 12.7 mm and a face portion of curved surface except for the blend R portion in the diagonally opposing portions. The glass panels were entirely strengthened physically, so that a compressive stress of 25 MPa was applied to at least an outer surface of the face portion. The dimensions of the glass panels used for Example 1 of the present invention and Comparative Example 1 and rates of the occurrence of an implosion are shown in Table 1.

The radius $R_b$ of the outer surface of the blend R portion in the diagonally opposing portion was changed from 12.7 mm to 16.5 mm. As a result, the rate of the occurrence of an implosion was reduced from 5% to 0%. There was no substantial change of the weight. The method of evaluation used is ruled in IEC65 wherein a steel ball of 40 mm diameter is hit with an energy of 5.5 J. The position to be hit was a point apart 20 mm in a shorter axis direction from a diagonally opposing end of the face portion (precisely, the screen portion) and apart 20 mm inwardly from that point in a longer axis direction, which was the point of the highest possibility of the occurrence of implosion in the range described in IEC65.

TABLE 1

| | Example 1 | Comparative Example 1 |
|---|---|---|
| Largest outer diameter D of panel (diagonal line) | 724 mm | 724 mm |
| Wall thickness of face at its central portion | 13.5 cm | 13.5 cm |
| Radius of curvature of outer surface of face (diagonal line) | 2,400 mm | 2,400 mm |
| Radius of curvature of inner surface of face (diagonal line) | 2,000 mm | 2,000 mm |
| $R_b$ (diagonal line) | 16.5 mm | 12.7 mm |
| $T_r$ (diagonal line) | 21.7 mm | 21.7 mm |
| 0.017D + 4.0 | 16.3 mm | 16.3 mm |
| 0.014D + 11.0 | 21.1 mm | 21.1 mm |
| Compressive stress of outer surface of face | 25 MPa | 25 MPa |
| Implosion rate (5.5J) | 0% | 5% |
| Weight of panel | 18.7 kg | 18.7 kg |

EXAMPLE 2

The glass panels were prepared by using the same glass material as Example 1. Each of the glass panels was for TV of 28-inch model (a reflection angle of 102°) having a substantially flat face portion which has an useful screen area of an aspect ratio of 16:9 and of a diagonal line of 66 cm. The glass panel used for Example 2 had the same configuration as the glass panel used for Comparative Example 2 except for the radius of curvature $R_b$ and the largest wall thickness $T_r$ of the blend R portion in the diagonally opposing portions. The glass panel for Example 2 was the same as that for Comparative Example 3 except for physically strengthening. The dimensions and rates of the occurrence of an implosion are shown in Table 2 along with those for Comparative Examples 2 and 3.

A radius of curvature $R_b$ of 20 mm was used instead of 8 mm in Comparative Example 2. Also, the inner surface of the blend R portion was adjusted so that the largest wall thickness $T_r$ of the blend R portion was changed from 23.4 mm to 20.8 mm. The glass panel of Example 2 was entirely strengthened physically, so that at least an outer surface of the face portion had a compressive stress of 25 MPa. As a result, the rate of the occurrence of an implosion was reduced from 40% to 0%. In comparison with the glass-panel for Comparative Example 3 having no compressive stress which underwent no physically strengthening, the rate of an implosion was reduced from 5% to 0%. The method of evaluation used was the same as that in Example 1.

TABLE 2

| | Example 2 | Comparative Example 2 | Comparative Example 3 |
|---|---|---|---|
| Largest outer diameter D of panel (diagonal line) | 708 mm | 708 mm | 708 mm |
| Wall thickness of face at its central portion | 15.5 mm | 15.5 mm | 15.5 mm |
| Radius of curvature of outer surface of face (diagonal line) | 100,000 mm | 100,000 mm | 100,000 mm |
| Radius of curvature of inner surface of face (diagonal line) | 9,000 mm | 9,000 mm | 9,000 mm |
| $R_b$ (diagonal line) | 20.0 mm | 8.0 mm | 20.0 mm |
| $T_r$ (diagonal line) | 20.8 mm | 23.4 mm | 20.8 mm |
| 0.017D + 4.0 | 16.0 mm | 16.0 mm | 16.0 mm |
| 0.014D + 11.0 | 20.9 mm | 20.9 mm | 20.9 mm |
| Compressive stress of outer surface of face | 25 MPa | 0 MPa | 0 MPa |
| Implosion rate (5.5J) | 0% | 40% | 5% |
| Weight of panel | 17.8 kg | 17.8 kg | 17.8 kg |

In the present invention, a very simple technique which is in combination of a physically strengthening treatment to the glass panel and an adjustment of the shape of the blend R portion in a diagonally opposing portion is used to reduce the rigidity of the diagonally opposing portion. As a result, a glass panel which is safe in use and which can suppress the occurrence of an implosion which is the most dangerous phenomenon in use of a cathode ray tube can be provided. Generally, the rate of the occurrence of an implosion in a cathode ray tube in which the face portion is made substantially flat in order to improve the visibility, tends to increase. However, the present invention can realize a glass panel for a cathode ray tube which is light in weight and safe and which can suppress the occurrence of an implosion without reducing the visibility and prevents an increase of weight.

What is claimed is:

1. A glass panel for an implosion-protected type cathode ray tube comprising a face portion of substantially rectangular shape and a skirt portion constituting a side wall of the face portion, wherein a compressive stress $\sigma_c$ of 7 MPa$\leqq|\sigma_c|\leqq$30 MPa is formed by physically strengthening in at least an outer surface of the face portion, and a relation between a radius of curvature $R_b$ of an outer surface of a blend R portion connecting the face portion to the skirt portion in a diagonal portion of the glass panel and a largest outer diameter D of the glass panel is $R_b \geqq 0.017D+4.0$.

2. The glass panel according to claim 1, wherein the face portion is substantially flat, and a relation between a largest wall thickness $T_r$ of the blend R portion in the diagonal portion of the glass panel and a largest outer diameter D of the panel is $T_r \leqq 0.014D+11.0$.

3. The glass panel according to claim 1, wherein a compressive stress $\sigma_c$ is formed by physically strengthening in at least an outer surface of the entire face portion.

4. An implosion-protected type cathode ray tube comprising the glass panel as defined in claim 1.

5. A glass panel for an implosion-protected type cathode ray tube comprising a face portion of substantially rectangular shape and a skirt portion constituting a side wall of the face portion, wherein a compressive stress $\sigma_c$ of 7 MPa$\leqq|\sigma_c|\leqq$30 MPa is formed in at least an outer surface of the face portion by physically strengthening the glass panel entirely, and a relation between a radius of curvature $R_b$ of an outer surface of a blend R portion connecting the face portion to the skirt portion in a diagonal portion of the glass panel and a largest outer diameter D of the glass panel is $R_b \geqq 0.017D+4.0$.

6. The glass panel according to claim 5, wherein the face portion is substantially flat.

7. The glass panel according to claim 6, wherein the face portion is substantially flat, and a relation between a largest wall thickness $T_r$ of the blend R portion in the diagonal portion of the glass panel and a largest outer diameter D of the panel is $T_r \leqq 0.014D+11.0$.

* * * * *